US006674251B2

(12) United States Patent
Langeslag et al.

(10) Patent No.: US 6,674,251 B2
(45) Date of Patent: Jan. 6, 2004

(54) MULTIPLE DISCHARGE LAMP BALLAST WITH EQUALIZER VOLTAGE PROTECTION

(75) Inventors: Wilhelmus Hinderikus Maria Langeslag, Nijmegen (NL); Antonius Henricus Peterus Johannes Habraken, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 45 days.

(21) Appl. No.: 10/106,952

(22) Filed: Mar. 26, 2002

(65) Prior Publication Data

US 2002/0140372 A1 Oct. 3, 2002

(30) Foreign Application Priority Data

Mar. 29, 2001 (EP) ..... 01201183

(51) Int. Cl.[7] ..... H05B 37/02
(52) U.S. Cl. ..... 315/291; 315/276

(58) Field of Search ..... 315/224, 225, 315/246, 291, 307, 308, 209 R, 219, 244, 276

(56) References Cited

U.S. PATENT DOCUMENTS 6,326,740 B1 * 12/2001 Chang et al. ..... 315/291
6,381,551 B1 * 4/2002 Raiser ..... 315/224
6,509,696 B2 * 1/2003 Brunning et al. ..... 315/209 R

FOREIGN PATENT DOCUMENTS

EP 1043918 A1 11/2000 ..... H05B/41/16

* cited by examiner

*Primary Examiner*—Wilson Lee

(57) ABSTRACT

In a circuit arrangement for operating at least two discharge lamps and comprising an equalizer transformer, removal or extinguishing of one of the lamps is detected by monitoring the voltage over the equalizer transformer and switching off the circuit arrangement in case the voltage over the equalizer transformer is higher than a reference voltage.

14 Claims, 1 Drawing Sheet

MULTIPLE DISCHARGE LAMP BALLAST WITH EQUALIZER VOLTAGE PROTECTION

BACKGROUND OF THE INVENTION

This invention relates to a circuit arrangement for operating at least two discharge lamps, provided with input terminals for connection to a supply voltage source, means I coupled to the input terminals for generating a high-frequency voltage from a supply voltage delivered by the supply voltage source, a load branch B coupled to the means I and comprising a first branch A comprising first lamp terminals for accommodating a discharge lamp and a first inductive element L1, a second branch C shunting the first branch A and comprising further lamp terminals for accommodating a discharge lamp and a second inductive element L2 which is magnetically coupled to the first inductive element L1 and forms an equalizer transformer together with the first inductive element L1, and means II coupled to the means I for adjusting the light output of the discharge lamps.

Such a circuit arrangement is known from EP 0766500. The known circuit arrangement is suitable for operating two discharge lamps. The equalizer transformer achieves during lamp operation that the currents through the two discharge lamps are approximately equal. This is important especially when the circuit arrangement offers the possibility of dimming the discharge lamps, since otherwise the luminous fluxes of the discharge lamps may differ considerably in the dimmed state, which is regarded as undesirable in many applications.

The known circuit arrangement is also equipped with means for limiting the voltage over the not yet ignited discharge lamp in case one of the discharge lamps has ignited while the other discharge lamp has not yet ignited. Damage to the not yet ignited discharge lamp is thereby prevented, while at the same time a current with a comparatively high amplitude through the equalizer transformer is prevented. It is a disadvantage of the known circuit arrangement, however, that removal of one of the discharge lamps from the lamp terminals can not easily be detected by monitoring the voltage between the lamp terminals. More in particular this is true in case the discharge lamps are dimmed. Safety requirements often demand that the operation of the circuit arrangement is stopped or changed in such a way that no dangerous situation results upon removal of one of the discharge lamps. For this reason many known ballast circuits for operating a discharge lamp are equipped with a stop circuit that monitors the voltage between the lamp terminals and for instance switches the ballast circuit off in case this voltage is higher than a predetermined value during a predetermined time interval. Such a stop circuit, however, would not function properly when applied in a circuit arrangement as disclosed in EP 0766500.

SUMMARY OF THE INVENTION

An object of the invention is to provide a circuit arrangement for operating at least two discharge lamps equipped with an equalizer transformer that is equipped with effective means to maintain safety in case one of the lamps is removed from the circuit arrangement.

A circuit arrangement as mentioned in the opening paragraph is therefore characterized in that the circuit arrangement is in addition provided with means III, coupled to the equalizer transformer for comparing a voltage over the equalizer transformer with a reference voltage and for changing the operating condition of the circuit arrangement in case the voltage over the equalizer transformer is higher than the reference voltage.

When one of the discharge lamps is removed from a circuit arrangement according to the invention the voltage over the equalizer transformer changes substantially. This was found to be true for a wide range of the light output of the discharge lamps. Lamp removal or extinguishing of one of the discharge lamps therefor dependably results in the equalizer voltage becoming higher than the reference voltage so that the means III change the operating condition of the circuit arrangement.

The change in operating condition can be an interruption of the supply voltage so that the circuit arrangement stops operating.

Alternatively, in a preferred embodiment the means I comprise two switching elements that are rendered alternately conductive and non-conductive by means of a control signal generated by a control circuit and the means III are equipped with means for interrupting the control signal. In this preferred embodiment adjusting the light output of the discharge lamps can be realized by changing the frequency of the high frequency voltage by changing the frequency of the control signal. Alternatively, it is also possible to adjust the light output of the discharge lamps by adjusting the duty cycle of the control signal.

It has been found that in case the light output of the lamps is adjusted at a very low level, e.g. less than 10% of the nominal light output, the rise in the voltage over the equalizer transformer resulting from removal of one of the lamps is relatively low. As a consequence lamp removal cannot be dependably detected in case the light output of the discharge lamps is chosen very low. Circuit arrangements that can control the light output of the discharge lamps at such a low level are often equipped with means IV for supplying electrode heating currents to the electrodes of the discharge lamps. These electrode heating currents can be increased in case the discharge currents through the discharge lamps and the light output of the discharge lamps both decrease. In this way the electrodes of the discharge lamps can be maintained at approximately the same temperature for different levels of the light output and the lamp life can be lengthened. A further preferred embodiment of the invention comprises means IV for supplying electrode heating currents to the electrodes of the discharge lamps and means V for comparing the sum of the electrode heating currents with a further reference voltage and for changing the operating condition of the circuit arrangement in case the sum of the electrode heating currents is smaller than the further reference voltage. The electrode heating current has a relatively high value when the light output of the discharge lamps is at a low level. When one of the discharge lamps is removed the electrode heating current through the electrodes of that discharge lamp changes from the relatively high value to zero. This results in a big enough change in the sum of the electrode heating currents to provide a dependable detection of lamp removal. The change in operating condition effected by the means V is preferably the same as the change effected by means III.

BRIEF DESCRIPTION OF THE DRAWING

An embodiment of the invention will be explained in more detail with reference to a drawing, in which.

DESCRIPTION OF THE PREFERRED EMBODIMENTS

Figure 1:
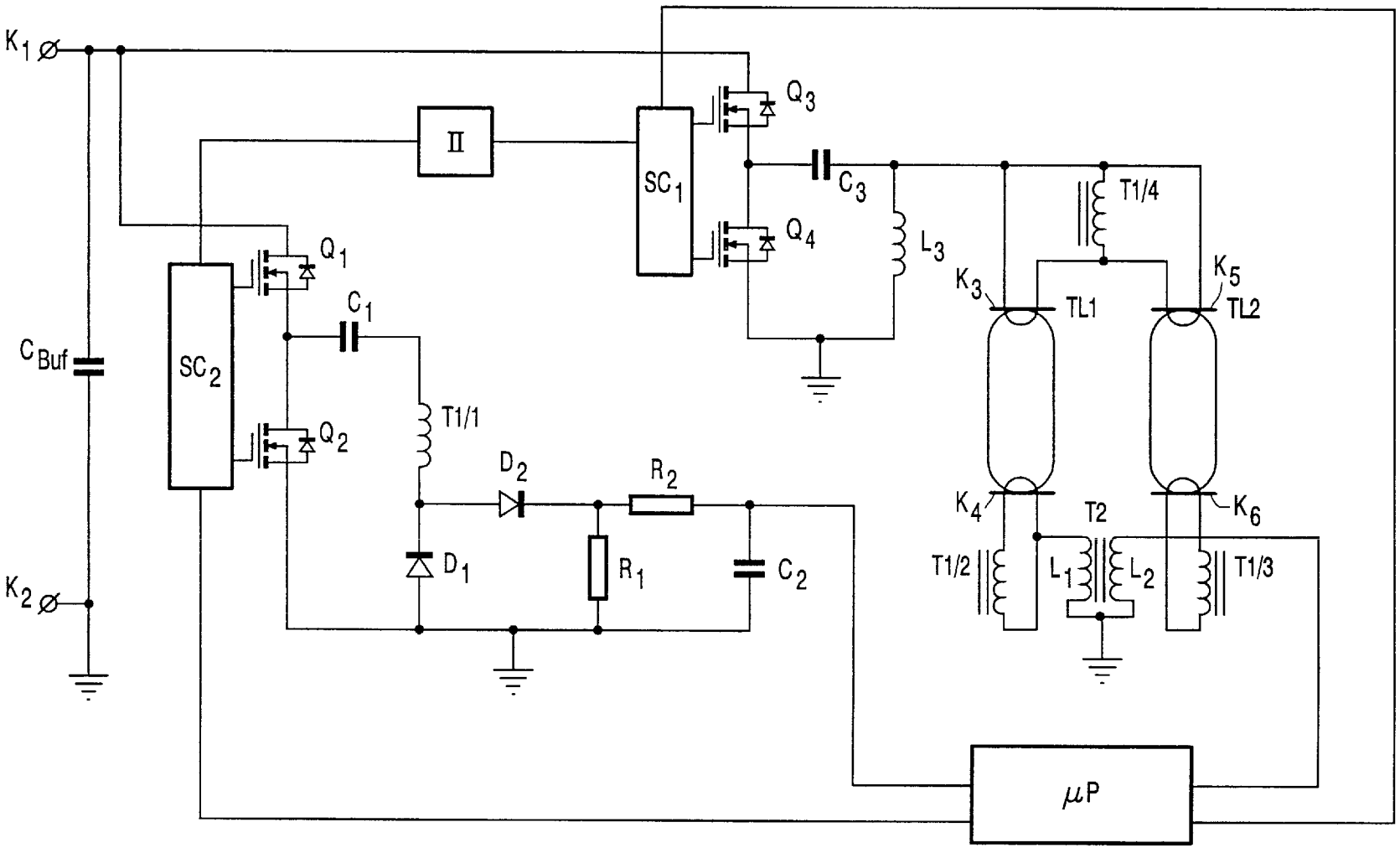
FIG. 1 is a diagram of an embodiment of a circuit arrangement according to the invention, with two discharge lamps connected thereto.

In the embodiment shown in FIG. 1, K1 and K2 form input terminals for connection to a supply voltage source. This supply voltage source must deliver a DC voltage in the present case. The supply voltage source can for instance be formed by a voltage source supplying a low frequency alternating voltage, such as the mains, in combination with a rectifier. Input terminals K1 and K2 are connected to each other by means of a buffer capacitor Cbuf Buffer capacitor Cbuf is shunted by a series arrangement of two switching elements Q3 and Q4. SC1 is a circuit part for generating a control signal for rendering the switching elements Q3 and Q4 alternately conductive and non-conductive. For that purpose respective output terminals of circuit part SC1 are coupled with respective control electrodes of switching elements Q3 and Q4. Switching elements Q3 and Q4 together with circuit portion SC1 form means I for generating a high-frequency voltage from the DC voltage. Switching element Q4 is shunted by a series arrangement of capacitor C3 and inductive element L3. Inductive element L3 is shunted by a series arrangement of lamp terminal K3, discharge lamp TL1, lamp terminal K4 and inductive element L1. This series arrangement forms a first branch A in this embodiment. Inductive element L3 is also shunted by a further series arrangement of lamp terminal K5, discharge lamp TL2, lamp terminal K6 and inductive element L2. Inductive element L1 is magnetically coupled with inductive element L2 and forms an equalizer transformer together with inductive element L2. This further series arrangement forms a second branch C in this embodiment. Capacitor C3, inductive elements L1, L2 and L3, lamp terminals K3–K6 and discharge lamps TL1 and TL2 together form a load branch B. Buffer capacitor Cbuf is also shunted by a further series arrangement of switching elements Q1 and Q2. Circuit part SC2 is a circuit part for generating a control signal for rendering the switching elements Q1 and Q2 alternately conductive and non-conductive. For this purpose respective output terminals of control circuit SC2 are coupled with respective control terminals of the switching elements Q1 and Q2. Switching element Q2 is shunted by a series arrangement of capacitor C1, primary winding T1/1 of electrode heating transformer T1 and diode D1. First secondary winding T1/4 of electrode heating transformer T1 shunts a first electrode of discharge lamp TL1. First secondary winding T1/4 of electrode heating transformer T1 also shunts a first electrode of discharge lamp TL2. Second secondary winding T1/3 of electrode heating transformer T1 shunts a second electrode of discharge lamp TL1. Third secondary winding T1/3 of electrode heating transformer T1 shunts a second electrode of discharge lamp TL2. Control circuit SC2, switching elements Q1 and Q2, capacitor C1 and electrode heating transformer T1 together forms means IV for supplying electrode heating currents to the electrodes of the discharge lamps. Diode D1 is shunted by a series arrangement of diode D2 and ohmic resistor R1. Ohmic resistor R1 is shunted by a series arrangement of ohmic resistor R2 and capacitor C2. A common terminal of ohmic resistor R2 and capacitor C2 is connected to a first input terminal of microprocessor $_{i}$P. A first output terminal of microprocessor $_{i}$P is connected to a first input terminal of control circuit SC2. A second input terminal of microprocessor $_{i}$P is connected to a common terminal of inductive element L2 and lamp terminal K6. A second output terminal of microprocessor $_{i}$P is connected to a first input terminal of control circuit SC1. In this embodiment the common terminal of inductive element L2 and lamp terminal K6, the microprocessor $_{i}$P and its connections with the first input terminal of control circuit SC1 and with the first input terminal of control circuit SC2 together form means III for comparing a voltage over the equalizer transformer with a reference voltage and for changing the operating condition of the circuit arrangement in case the voltage over the equalizer transformer is higher than the reference voltage. Diodes D1 and D2, ohmic resistors R1 and R2, capacitor C2 and microprocessor $_{i}$P and its connections with the first input terminal of control circuit SC1 and with the first input terminal of control circuit SC2 together form means V for comparing a signal representing the sum of the electrode heating currents with a further reference voltage and for changing the operating condition of the circuit arrangement in case the signal representing the sum of the electrode heating currents is smaller than the further reference voltage. Circuit part II is a circuit part for adjusting the light output of the discharge lamps. In this embodiment circuit part II forms means II for adjusting the light output of the discharge lamps. A first output terminal of circuit part II is therefor connected with a second input terminal of the control circuit SC1. In order to increase the electrode heating currents when the light output of the discharge lamps is decreased, a second output terminal of circuit part II is also connected with a second input terminal of control circuit SC1.

The operation of the embodiment shown in FIG. 1 is as follows.

In case the input terminals K1 and K2 are connected to a supply voltage source supplying a DC voltage, the control circuit SC1 generates a control signal that renders the switching elements Q3 and Q4 alternately conductive and non-conductive. As a result a substantially square wave shaped voltage is present at a common terminal of switching element Q3 and switching element Q4, and an AC current having the same frequency as the substantially square wave shaped voltage flows through the load branch B. The equalizer transformer T2 ensures that the current through the discharge lamp TL1 is approximately equal to the current through the discharge lamp TL2. The control circuit SC2 also generates a control signal that renders switching elements Q1 and Q2 alternately conductive and non-conductive. As a result a further substantially square wave shaped voltage is present at a common terminal of switching element Q1 and switching element Q2 and an AC current with the same frequency flows through the primary winding T1/1 of electrode heating transformer T1. As a consequence AC voltages are present over each of the three secondary windings T1/2, T1/3 and T1/4 of electrode heating transformer T1. These AC voltages make electrode heating currents flow through each of the electrodes of the discharge lamps. A user of the circuit arrangement can adjust the light output of the discharge lamps by means of circuit part II. Circuit part II can for instance change the frequency and/or the duty cycle of the control signal generated by control circuit SC1. In the embodiment shown in FIG. 1 circuit part II additionally effects an increase in electrode heating current in case the light output of the discharge lamps is decreased and a decrease in electrode heating current in case the light output of the discharge lamps is increased. Circuit part II can for instance change the frequency and/or duty cycle of the control signal generated by control circuit SC2.

In case the light output of the discharge lamps is higher than a predetermined fraction of its nominal value, and which depends on the dimensioning of the circuit and the discharge lamps operated by it, removal of a lamp from the circuit causes the voltage across the equalizer transformer to increase relatively strongly. This voltage is present at the first input terminal of the microprocessor $\mu$P and is compared by the microprocessor $\mu$P with a reference voltage generated internally in the microprocessor by means nor explicitly shown in FIG. 1. In case of a lamp removal, the voltage across the equalizer transformer increases to such an extent that it is higher than the reference voltage. As a result the microprocessor switches off both of the control circuits and thereby interrupts the control signals generated by the control circuits SC1 and SC2 via its first and second output terminals and high voltages are no longer present between the lamp terminals. Thus, it is assured that the circuit arrangement is safe, even when lamp(s) are removed while the circuit arrangement is in operation. It is noted that in order to mast safety requirements it would have been sufficient to switch off control circuit SC1 only. However, since electrode heating is not meaningful when the lamps are not burning, energy saving is accomplished by switching off the control circuit SC2 as well.

In case the light output of the discharge lamps is adjusted at a value that is lower than the predetermined fraction of its nominal value mentioned hereabove, removal of a lamp from the circuit arrangement does no longer cause a big enough increase in the voltage over the equalizer transformer to make sure that the means III switch off the both control circuits. However, the voltage that is present at a common terminal of resistor R2 and capacitor C2 forms a signal that represents the sum of the electrode heating currents. As explained hereabove the electrode heating currents have a relatively high amplitude when the light output of the discharge lamps is relatively low. As a consequence the signal representing the sum of the electrode heating currents decreases to a relatively large extent when a discharge lamp is removed from the circuit arrangement. The signal representing the sum of the electrode heating currents is also present at the second input terminal of the microprocessor $_{1}$P. When, upon lamp removal, the signal decreases below the value of a further reference voltage generated internally in the microprocessor by means not explicitly shown in FIG. 1, the microprocessor switches off the both control circuits and thereby interrupts the control signals generated by the control circuits SC1 and SC2 via its first and second output terminals and high voltages are no longer present between the lamp terminals. Thus it is assured that the circuit arrangement is safe, even when lamp(s) are removed while the circuit arrangement is in operation.

What is claimed is:

1. A circuit arrangement for operating at least two discharge lamps, comprising:

input terminals for connection to a supply voltage source, first means coupled to the input terminals for generating a high-frequency voltage from a supply voltage delivered by the supply voltage source, a load branch coupled to the first means and comprising a first branch comprising first lamp terminals for accommodating a discharge lamp and a first inductive element, a second branch shunting the first branch and comprising further lamp terminals for accommodating a discharge lamp and a second inductive element which is magnetically coupled to the first inductive element and forms an equalizer transformer together with the first inductive element, and second means coupled to the first means for adjusting the light output of the discharge lamps, characterized in that the circuit arrangement further comprises third means coupled to the equalizer transformer for comparing a voltage across the equalizer transformer with a reference voltage and for changing the operating condition of the circuit arrangement if the voltage across the equalizer transformer is higher than the reference voltage.

2. A circuit arrangement as claimed in claim 1, wherein the third means comprise means for interrupting the supply voltage.

3. A circuit arrangement as claimed in claim 1, wherein the first means comprise two switching elements that are rendered alternately conductive and non-conductive by means of a control signal generated by a control circuit, and wherein the third means include means for interrupting the control signal.

4. A circuit arrangement as claimed in claim 1, wherein the second means include means for controlling the frequency of the high-frequency voltage.

5. A circuit arrangement as claimed in claim 3, wherein the second means includes means for adjusting the duty cycle of the control signal.

6. A circuit arrangement as claimed in claim 1, wherein the circuit arrangement further comprises fourth means for supplying electrode heating currents to electrodes of the discharge lamps and with fifth means for comparing a signal representing the sum of the electrode heating currents with a further reference voltage and for changing the operating condition of the circuit arrangement if the signal representing the sum of the electrode heating currents is smaller than the further reference voltage.

7. The circuit arrangement as claimed in claim 1 wherein the input terminals are intended for connection to a DC supply voltage source.

8. The circuit arrangement as claimed in claim 1 further comprising:

means for supplying electrode heating currents to electrodes of the discharge lamps, means for comparing a signal representing the sum of the electrode heating currents with a further reference voltage, and means responsive to an output signal of the comparing means for changing the operating condition of the circuit arrangement if the signal representing the sum of the electrode heating currents reaches the level of the further reference voltage.

9. The circuit arrangement as claimed in claim 8 wherein the third means, the signal comparing means and the operating condition changing means are all part of a microprocessor.

10. The circuit arrangement as claimed in claim 1 wherein:

the first inductive element of and the first lamp terminals are connected in series circuit in the first branch, and the second inductive element and the further lamp terminals are connected in series circuit in the second branch.

11. The circuit arrangement as claimed in claim 8 wherein the second means is operative to control the level of the electrode heating currents as a function of the light output of the discharge lamps.

12. The circuit arrangement as claimed in claim 1 further comprising:

means for supplying electrode heating currents to the electrodes of the discharge lamps, and the third means changes the circuit operating condition by interrupting the high frequency voltage to the load branch and by interrupting the supply of electrode heating currents when it interrupts the high frequency voltage.

13. The circuit arrangement as claimed in claim 1 wherein:

the first means comprise first and second switching transistors coupled in series circuit to the input terminals, and the load branch comprises:

a capacitor and a third inductive element connected in a series circuit across the second switching transistor, and the first and second branches are connected in parallel and across the third inductive element.

14. The circuit arrangement as claimed in claim 1 wherein the change in the circuit operating condition includes a change in the mode of circuit operation.

* * * * *